US011335989B2

(12) United States Patent
Abdul-Hadi et al.

(10) Patent No.: US 11,335,989 B2
(45) Date of Patent: May 17, 2022

(54) SECTORIZED ANTENNA ASSEMBLY

(71) Applicant: Landis+Gyr Innovations, Inc., Alpharetta, GA (US)

(72) Inventors: Louay Abdul-Hadi, Woodstock, GA (US); Patrick Spokas, Alpharetta, GA (US); Mark Berkobin, Marietta, GA (US)

(73) Assignee: Landis+Gyr Innovations, Inc., Alpharetta, GA (US)

( * ) Notice: Subject to any disclaimer, the term of this patent is extended or adjusted under 35 U.S.C. 154(b) by 0 days.

(21) Appl. No.: 17/007,502

(22) Filed: Aug. 31, 2020

(65) Prior Publication Data

US 2022/0069433 A1 Mar. 3, 2022

(51) Int. Cl.

| | |
|---|---|
| ***H01Q 1/12*** | (2006.01) |
| ***H01Q 9/04*** | (2006.01) |
| ***H01Q 3/04*** | (2006.01) |

(52) U.S. Cl.

CPC ..... *H01Q 1/1221* (2013.01); *H01Q 1/1228* (2013.01); *H01Q 1/1264* (2013.01); *H01Q 3/04* (2013.01); *H01Q 9/0407* (2013.01)

(58) Field of Classification Search

CPC .... H01Q 1/1221; H01Q 1/228; H01Q 1/1264; H01Q 3/04; H01Q 9/0407

See application file for complete search history.

(56) References Cited

U.S. PATENT DOCUMENTS

| | | | | |
|---|---|---|---|---|
| 7,084,834 | B1 * | 8/2006 | Hopkins | H01Q 1/1228 343/878 |
| 7,106,273 | B1 * | 9/2006 | Brunson | H01Q 1/246 343/890 |
| 2006/0092090 | A1 * | 5/2006 | Greenfield | H01Q 1/1228 343/890 |

* cited by examiner

*Primary Examiner* — Hoang V Nguyen

(74) *Attorney, Agent, or Firm* — Kilpatrick Townsend & Stockton LLP

(57) ABSTRACT

A sectorized antenna assembly includes a mounting device, a support arm, a first antenna assembly, and a second antenna assembly. The mounting device supports the sectorized antenna assembly on a structure, and the support arm is connected to the mounting device and extends outwards from the mounting device in a lateral direction. The first antenna assembly is directly connected to the mounting device. The second antenna assembly is supported by the support arm such that the support arm is between the second antenna assembly and the mounting device and such that the second antenna assembly is offset in the lateral direction from the mounting device compared to the first antenna assembly.

20 Claims, 12 Drawing Sheets

SECTORIZED ANTENNA ASSEMBLY

FIELD OF THE INVENTION

This application relates to antenna assemblies for nodes of a network, and, more particularly, to sectorized antenna assemblies for nodes of a network.

BACKGROUND

Wireless mesh networks, such as those utilized by resource distribution networks (e.g., power, gas, or water distribution networks), often utilize one or more network nodes, such as a network gateway, to support communications between various sensors, devices, and users of the resource distribution network. Communications to and from the nodes are enabled by one or more antennas. To provide sufficient coverage, existing antennas must be installed remotely and vertically offset from the node. Such installations result in an inefficient use of valuable real estate on a support structure such as a utility pole. For example, such installations may require at least 23 feet of vertical space on the support structure to provide the sufficient coverage. Moreover, the remote relative positioning of the antennas and nodes of such installations limits the access to the individual components and/or requires extra time to access for situations such as installation, servicing, replacement, etc.

SUMMARY

Embodiments covered by this patent are defined by the claims below, not this summary. This summary is a high-level overview of various embodiments and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a sectorized antenna assembly includes a mounting device, a support arm, a first antenna assembly, and a second antenna assembly. The mounting device is configured to support the sectorized antenna assembly on a structure. The support arm is connected to the mounting device and extends outwards from the mounting device in a lateral direction. The first antenna assembly includes a first antenna bracket and a first sector antenna. In certain examples, the first antenna bracket is directly connected to the mounting device and supports the first sector antenna. The second antenna assembly includes a second antenna bracket and a second sector antenna. The second sector antenna is supported on the second antenna bracket, and in certain embodiments, the second antenna assembly is supported by the support arm such that the support arm is between the second sector antenna and the mounting device and such that the second antenna assembly is offset in the lateral direction from the mounting device compared to the first antenna assembly.

According to various embodiments, a sectorized antenna assembly includes a mounting device, a first antenna assembly, and a second antenna assembly. The mounting device is configured to support the sectorized antenna assembly on a structure. The first antenna assembly includes a first antenna bracket and a first sector antenna, and the first antenna bracket supports the first sector antenna relative to the mounting device. The second antenna assembly includes a second antenna bracket and a second sector antenna, and the second antenna bracket supports the second sector antenna relative to the mounting device. In certain embodiments, the first sector antenna is at a first vertical height relative to the mounting device, and the second sector antenna is at a second vertical height relative to the mounting device that is vertically offset from the first vertical height and such that the first sector antenna at least partially overlaps the second sector antenna in a lateral direction.

According to some embodiments, a sectorized antenna assembly includes a mounting device, a first antenna assembly, and a second antenna assembly. The mounting device is configured to support the sectorized antenna assembly on a structure. In various embodiments, the mounting device includes at least one of a first type of mounting device or a second type of mounting device that is different from the first type of mounting device. The first antenna assembly includes a first antenna bracket and a first sector antenna, and the first antenna bracket is directly connected to the mounting device and supports the first sector antenna. The second antenna assembly includes a second antenna bracket and a second sector antenna, and the second antenna bracket is directly connected to the mounting device and supports the second sector antenna. In certain embodiments, the first antenna bracket and the second antenna bracket each include a first mounting feature configured to connect to the first type of mounting device and a second mounting feature configured to connect to the second type of mounting device.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The specification makes reference to the following appended figures, in which use of like reference numerals in different figures is intended to illustrate like or analogous components.

DETAILED DESCRIPTION

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "vertical," "horizontal," "lateral," "longitudinal," "front," and "back," among others, are intended to refer to the orientation as illustrated and described in the figure (or figures) to which the components and directions are referencing.

Described herein is a sectorized antenna assembly for a node of a mesh network. In certain aspects, the sectorized antenna assembly includes one or more universal mounting brackets with mounting features such that the sectorized antenna assembly can be mounted on various support structures or surfaces as desired, including, but not limited to, wooden poles, metal poles, flat surfaces, etc. In certain embodiments, the sectorized antenna assembly supports a plurality of sector or directional antennas within a confined vertical space, thereby minimizing the vertical space needed on the support structure or surface. In some cases, the confined space may be a height of about 36 inches, although it need not be 36 inches in other examples. In various examples, the sectorized antenna assembly includes a support arm that supports at least one sector antenna such that the at least one sector antenna is offset from the support structure or surface compared to another sector antenna of the sectorized antenna assembly. In some embodiments, the support arm may support the node of the mesh network in addition to the at least one sector antenna. In certain embodiments, a length of the support arm is adjustable such that a distance between the at least one sector antenna (and optionally the node) and the support structure is adjustable. Optionally, a bracket supporting a particular sector antenna of the sectorized antenna assembly is tiltable such that the particular sector antenna can be controlled to more effectively cover a particular area and/or to minimize interference in wireless transmissions. In certain cases, the sectorized antenna assembly is collapsible.

Figure 12:
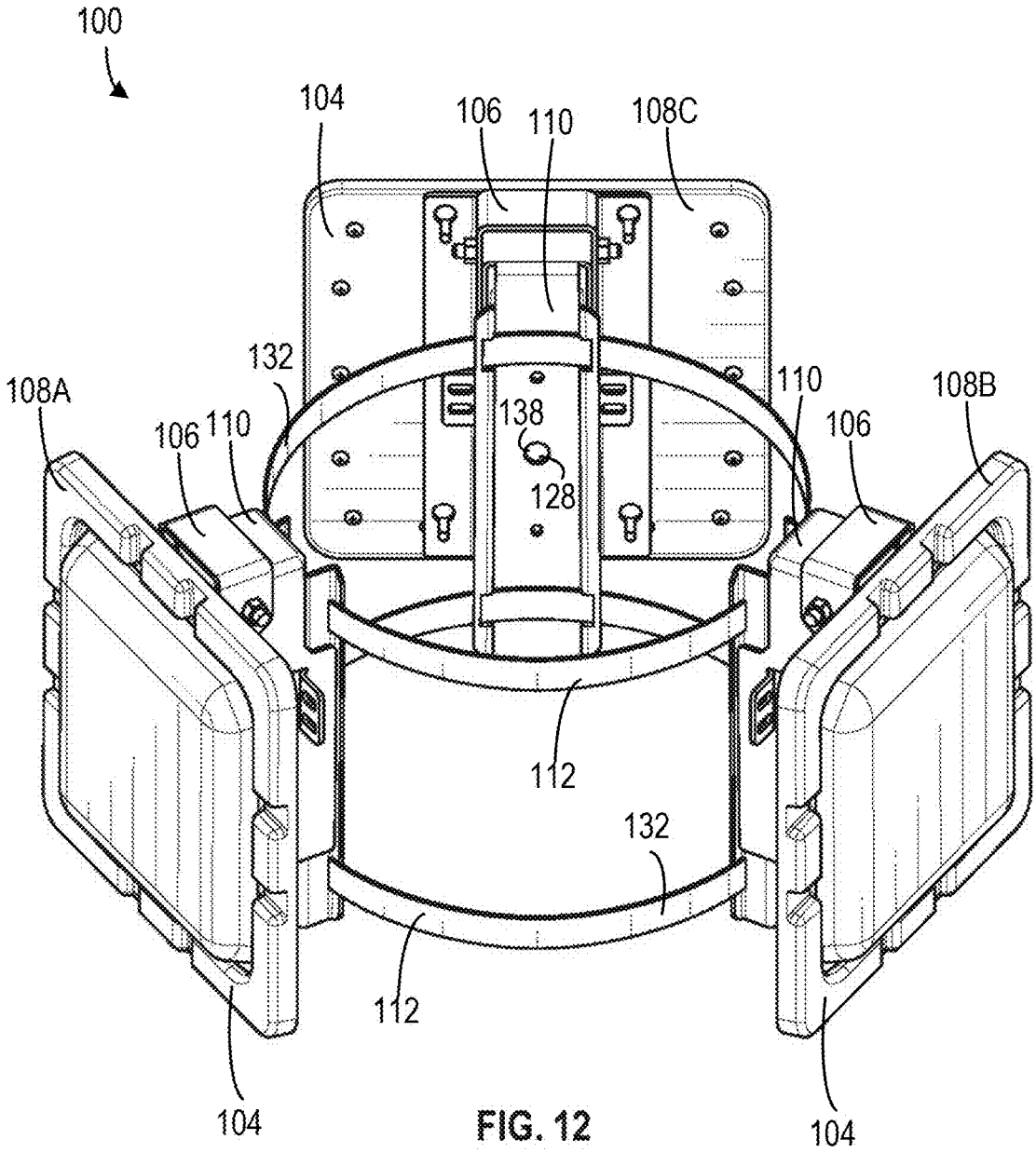
FIG. 12 is a perspective view of the sectorized antenna assembly of FIG. 1 in a second mounting configuration according to various embodiments.
Figure 13:
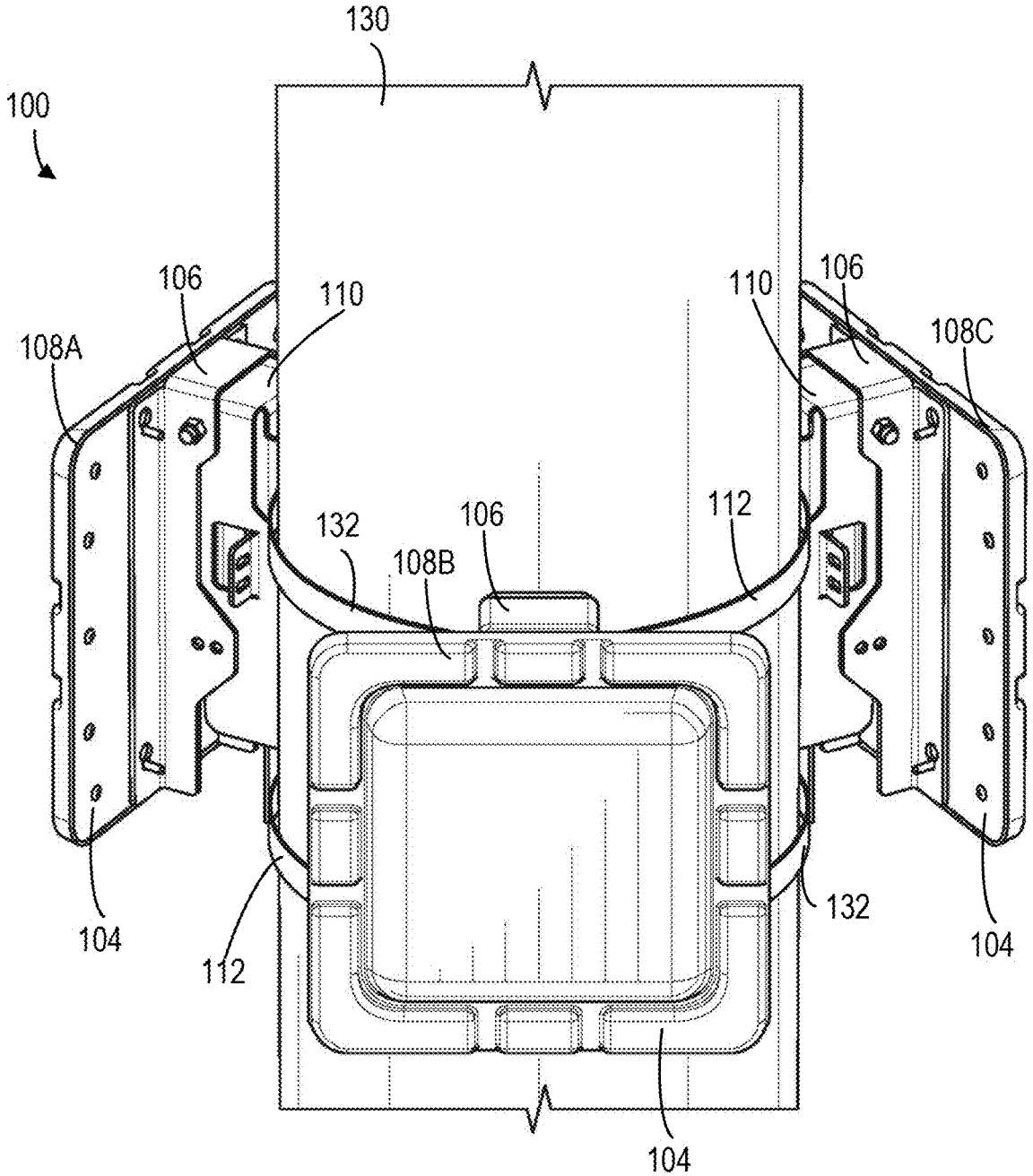
FIG. 13 is a perspective view of the sectorized antenna assembly of FIG. 1 in the second mounting configuration and mounted on the structure according to various embodiments.
Figure 14:
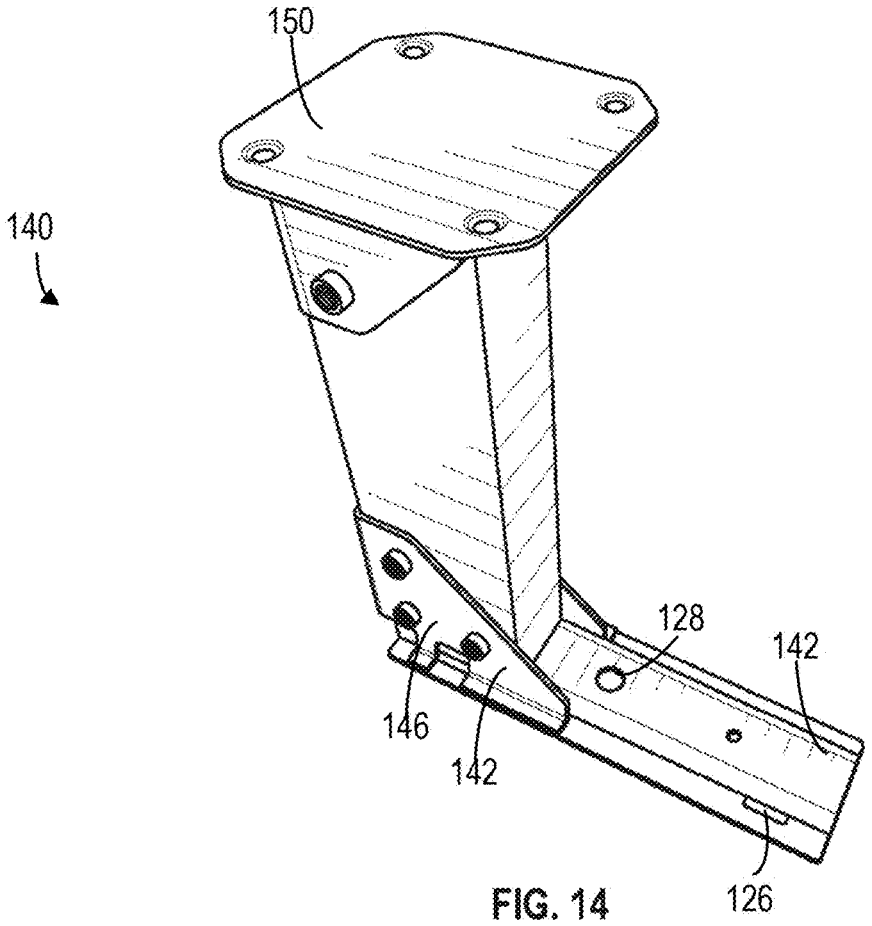
FIG. 14 is a perspective view of the support arm and the support bracket of the sectorized antenna assembly of FIG. 1 in an assembled configuration.
Figure 15:
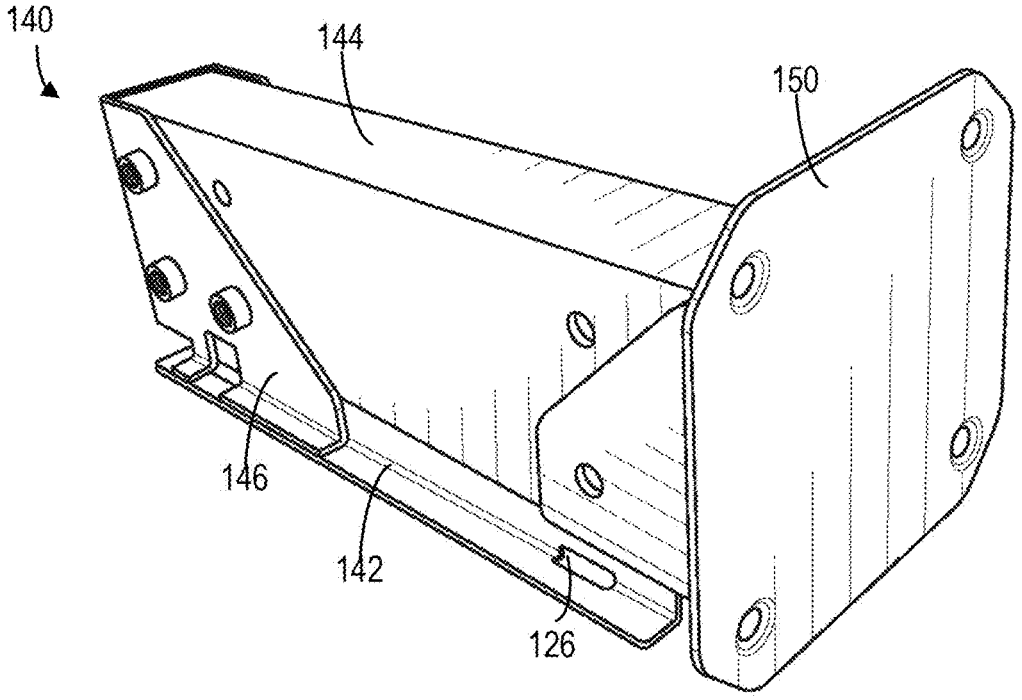
FIG. 15 is a perspective view of the support arm and the support bracket of the sectorized antenna assembly of FIG. 1 in a disassembled configuration.

FIGS. 1-16 illustrate a sectorized antenna assembly 100 according to various embodiments. The sectorized antenna assembly 100 includes one or more sector antennas 104 and is communicatively coupled with a node 102 of a mesh network, such as a network gateway, such that one or more radios and/or other components of the node 102 can transmit and receive signals via the one or more sector antennas 104. In some embodiments, and as best illustrated in FIGS. 1-6, the node 102 is supported by the sectorized antenna assembly 100. In other embodiments, and as best illustrated in FIGS. 12 and 13, the sectorized antenna assembly 100 need not support the node 102, which may allow for the one or more sector antennas 104 to be mounted at a location remote from the node 102.

Figure 16:
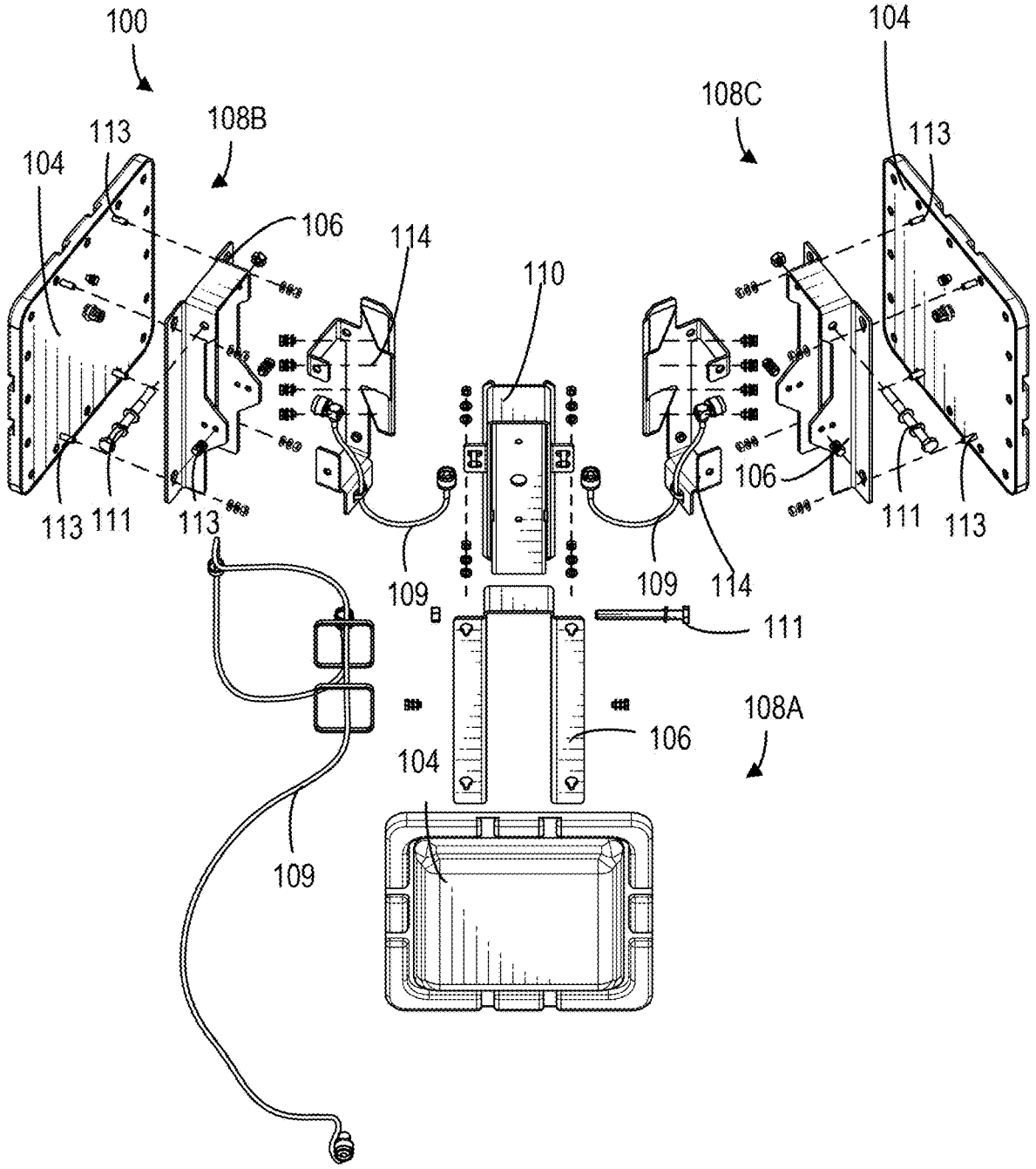
FIG. 16 is another assembly view of a portion of the sectorized antenna assembly of FIG. 1.

Each of the one or more sector antennas 104 have a radiation pattern or coverage measured in degrees of an arc. In the embodiment of FIGS. 1-16, each sector antenna 104 provides 120° coverage and the sectorized antenna assembly 100, as a whole, provides 360° coverage. In other embodiments, one or more of the sector antennas 104 may provide a different degree of coverage (e.g., 60°, 90°, etc.), and the sectorized antenna assembly 100 need not provide 360° coverage. Each sector antenna 104 is supported on an antenna bracket 106, and the sector antenna 104 and the antenna bracket 106 together define an antenna assembly 108. As best illustrated in FIG. 16, each antenna assembly 108 may also include wiring 109. In various embodiments, each sector antenna 104 may be connected to the corresponding antenna bracket 106 via various suitable attachment mechanisms, including but not limited to mechanical fasteners such as bolts 113, and pins 111 and/or bolts 113 and/or other fasteners or other hardware may also be used to secure the various components of the antenna assembly 108 together. In FIGS. 1-16, the sectorized antenna assembly 100 is illustrated with three antenna assemblies 108A-C.

In some embodiments, at least one antenna assembly 108A-C is supported on a mounting bracket 110 that is directly connected to one or more mounting devices 112 (discussed in detail below). As one non-limiting example, in the configuration illustrated in FIGS. 12 and 13, each antenna assembly 108A-C is supported on a corresponding mounting bracket 110. In various embodiments, at least one antenna assembly 108A-C is supported laterally offset from the one or more mounting devices 112. As a non-limiting example, in the configuration illustrated in FIGS. 1-6, the antenna assembly 108A is supported on the mounting bracket 110, and the antenna assemblies 108B-C are supported on intermediate brackets 114 that are not directly connected to the one or more mounting devices 112. In some cases, and as discussed below, the intermediate brackets 114 may be utilized when the sectorized antenna assembly 100 is configured to accommodate the node 102. In various embodiments, each of the antenna assemblies 108A-C may be connected to the corresponding mounting bracket 110 or the corresponding intermediate bracket 114 via various suitable attachment mechanisms, including but not limited to mechanical fasteners.

Figure 11:
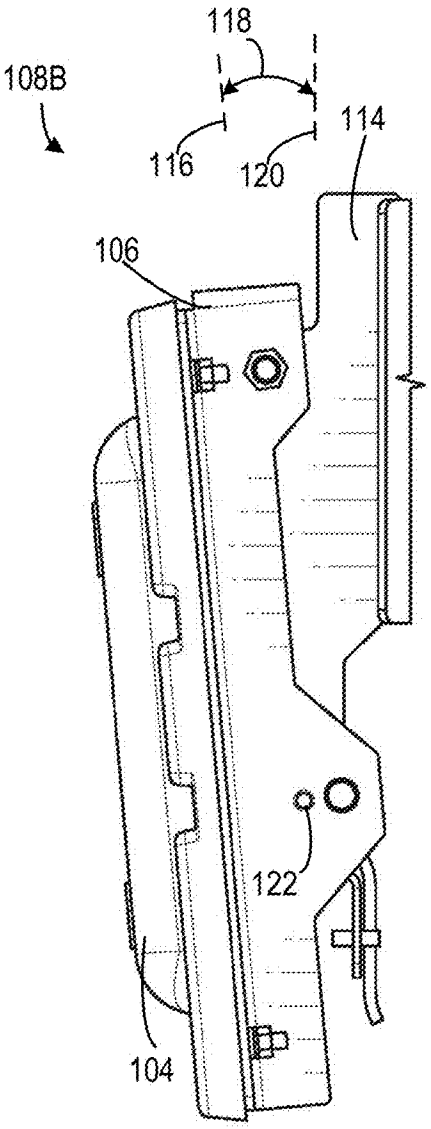
FIG. 11 is a side view of the antenna bracket of FIG. 11 if a tilted configuration according to various embodiments.
Figure 10:
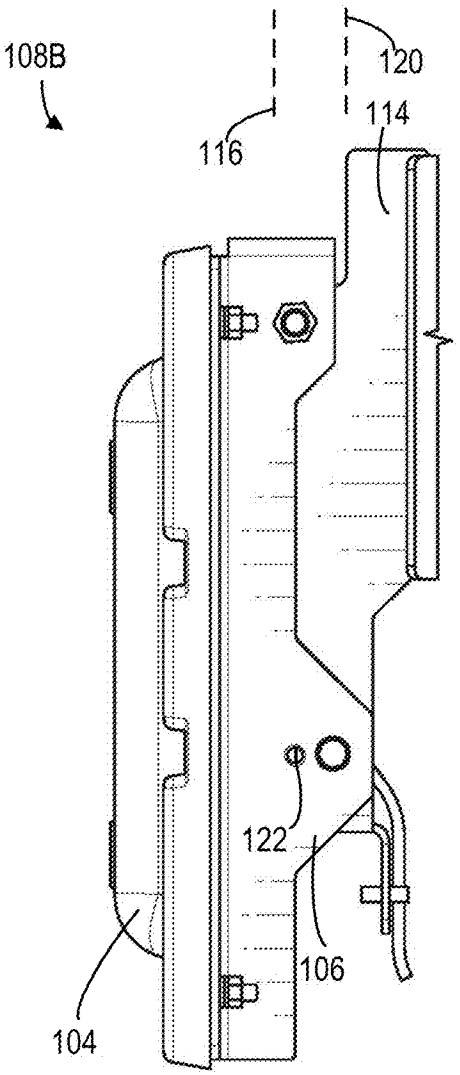
FIG. 10 is a side view of the antenna bracket of the sectorized antenna assembly of FIG. 1 in an un-tilted configuration according to various embodiments.

Referring to FIGS. 10 and 11, in various embodiments, each antenna bracket 106 is optionally tiltable such that an axis 116 of the particular antenna assembly 108A-C is movable to extend at a non-parallel angle 118 relative to a vertical axis 120. Optionally, prior to tilting, and as illustrated in FIG. 10, the axis 116 may be substantially parallel to the vertical axis 120. In various aspects, the non-parallel angle 118 may be from greater than 0° to about 5°, although in other examples, the non-parallel angle 118 may be greater than about 5°. Optionally, the antenna bracket 106 includes at least one indicator 122 that visually or otherwise indicates that the antenna bracket 106 is tilted to a particular angle relative to the vertical axis 120. In one non-limiting example, the at least one indicator 122 may be partially covered or filled when the antenna bracket 106 is not tilted (see FIG. 10) and the at least one indicator 122 may be uncovered or unobstructed when the antenna bracket 106 is at a maximum tilt angle (see FIG. 11). The tiltable antenna bracket 106 may allow for each sector antenna 104 to more effectively cover a particular area and reach other devices and/or may minimize interference in wireless transmissions. In certain aspects, an antenna bracket 106 may be tiltable regardless of whether the antenna bracket 106 is supported on the mounting bracket 110 or the intermediate bracket 114.

As previously mentioned, each antenna assembly 108A-C may be supported on a mounting bracket 110 (directly to the one or more mounting devices 112) or an intermediate bracket 114 (indirectly to the one or more mounting devices 112). In some optional examples, at least one antenna assembly (e.g., antenna assemblies 108B-C) may be supported on a corresponding intermediate bracket 114 (with or without the node 102) and offset from the one or more mounting devices 112 to minimize or reduce signal shadowing.

Referring to the mounting bracket 110, and as best illustrated in FIGS. 1-6, 9, and 12, the mounting bracket 110 is elongated and includes a support region 124 that engages and supports the antenna bracket 106. The mounting bracket 110 is a universal mounting bracket and includes at least one first mounting feature 126 that is configured to connect to a first type of mounting device 112 and at least one second mounting feature 128 that is configured to connect to a second type of mounting device 112 such that the mounting bracket 110 directly connects with the one or more mounting devices 112. In various embodiments, the mounting bracket 110 may include more than one first mounting feature 126, more than one second mounting feature 128, and/or additional mounting features configured to accommodate and connect to additional types of mounting devices 112 as desired. In the embodiment of FIGS. 1-16, the mounting bracket 110 includes two first mounting features 126 and one second mounting feature 128. As used herein, different "types" of mounting devices 112 refer to mounting devices that engage a support surface or structure 130 via different mechanisms or manners, and does not refer to a plurality of mounting devices 112 that engage the support structure 130 in the same manner.

In FIGS. 1-16, the sectorized antenna assembly 100 can accommodate two types of mounting devices 112: metal bands 132 are a first type of mounting device 112, and a bolt or rod 134 is a second type of mounting device 112. In this embodiment, the first mounting features 126 include pairs of aligned slots 136 (having a closed perimeter) extending in a lateral direction and that may selectively receive the metal bands 132, and the second mounting feature 128 is an aperture 138 that extends in the lateral direction and substantially perpendicular to the slots 136. The disclosure of the rod 134 and the metal bands 132 (and the associated first mounting features 126 and second mounting features 128) should not be considered limiting, and various other types of mounting devices 112 may be utilized. Moreover, while the mounting bracket 110 may accommodate more than one type of mounting device 112, in some embodiments, only one type of mounting device 112 may be needed to support the sectorized antenna assembly 100 on the support structure 130. For example, FIGS. 12 and 13 illustrate the sectorized antenna assembly 100 utilizing only the metal bands 132 while FIGS. 1-6 illustrate both the metal bands 132 and the rod 134 being utilized to support the sectorized antenna assembly 100 on the support structure 130.

In embodiments where one or more of the antenna assemblies 108A-C (and/or the node 102) are offset in the lateral direction, the sectorized antenna assembly 100 may include a support arm assembly 140. The support arm assembly 140 generally includes a support arm bracket 142 and a support arm 144. The support arm 144 may be connected to the support arm bracket 142 via various suitable attachment mechanisms, including but not limited to mechanical fasteners. In some embodiments, and referring to FIGS. 14 and 15, the support arm assembly 140 may be movable between a collapsed configuration (FIG. 15) and an assembled configuration (FIG. 14) such that a size of the support arm assembly 140 can be minimized for certain situations including, but not limited to, shipping of the support arm assembly.

Figure 1:
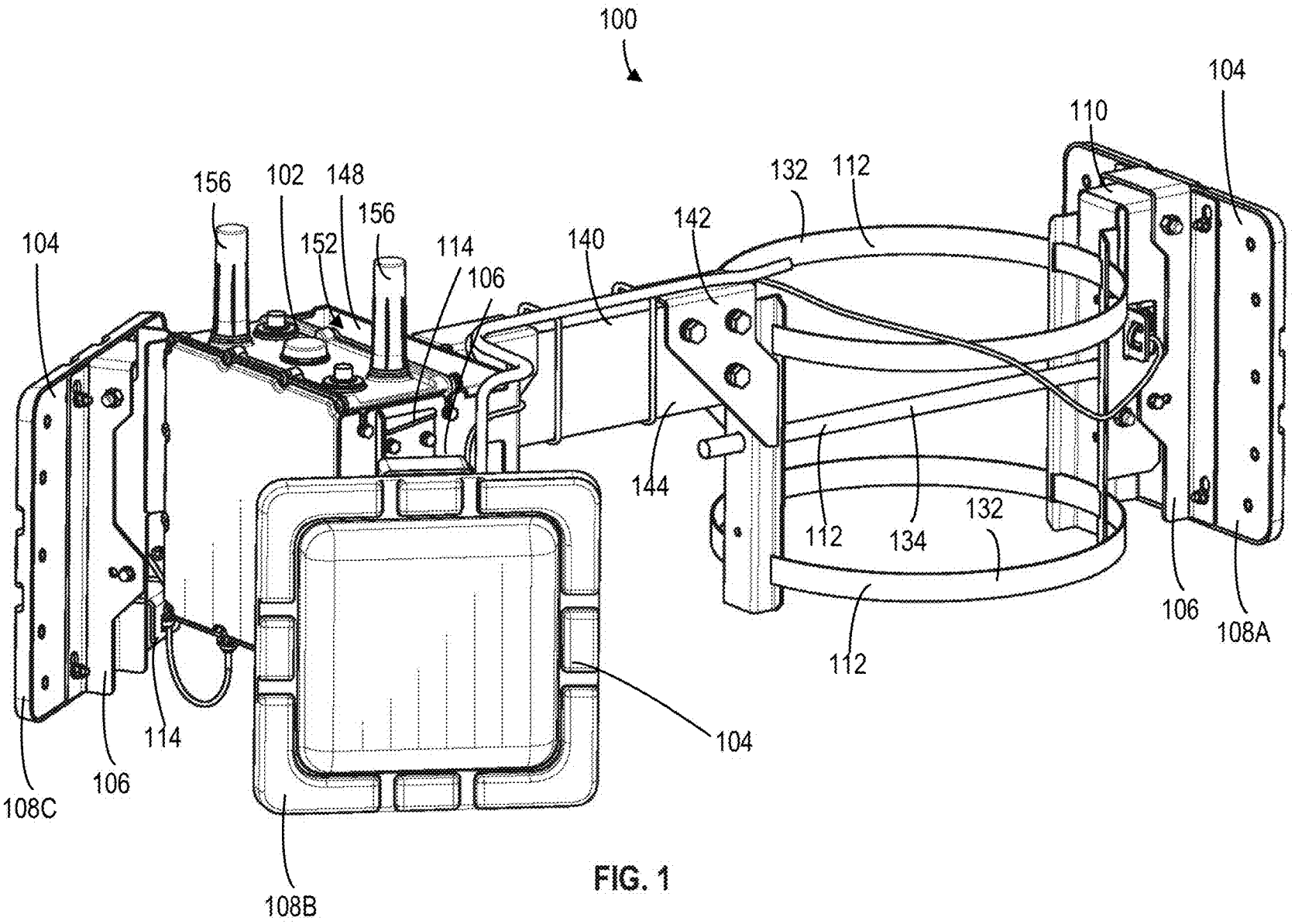
FIG. 1 is a perspective view of a sectorized antenna assembly according to embodiments.
Figure 2:
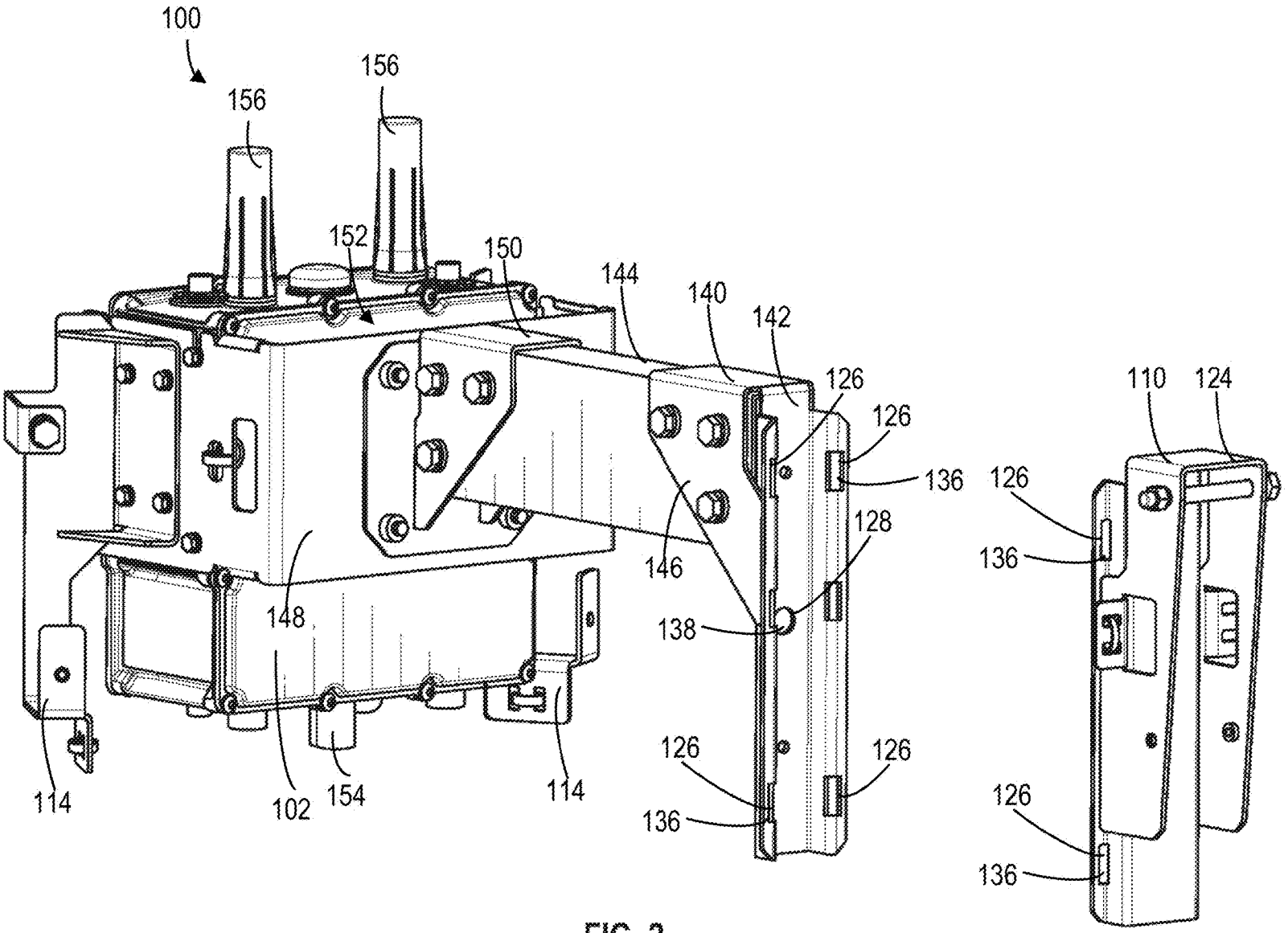
FIG. 2 is a perspective view of a portion of the sectorized antenna assembly of FIG. 1.
Figure 3:
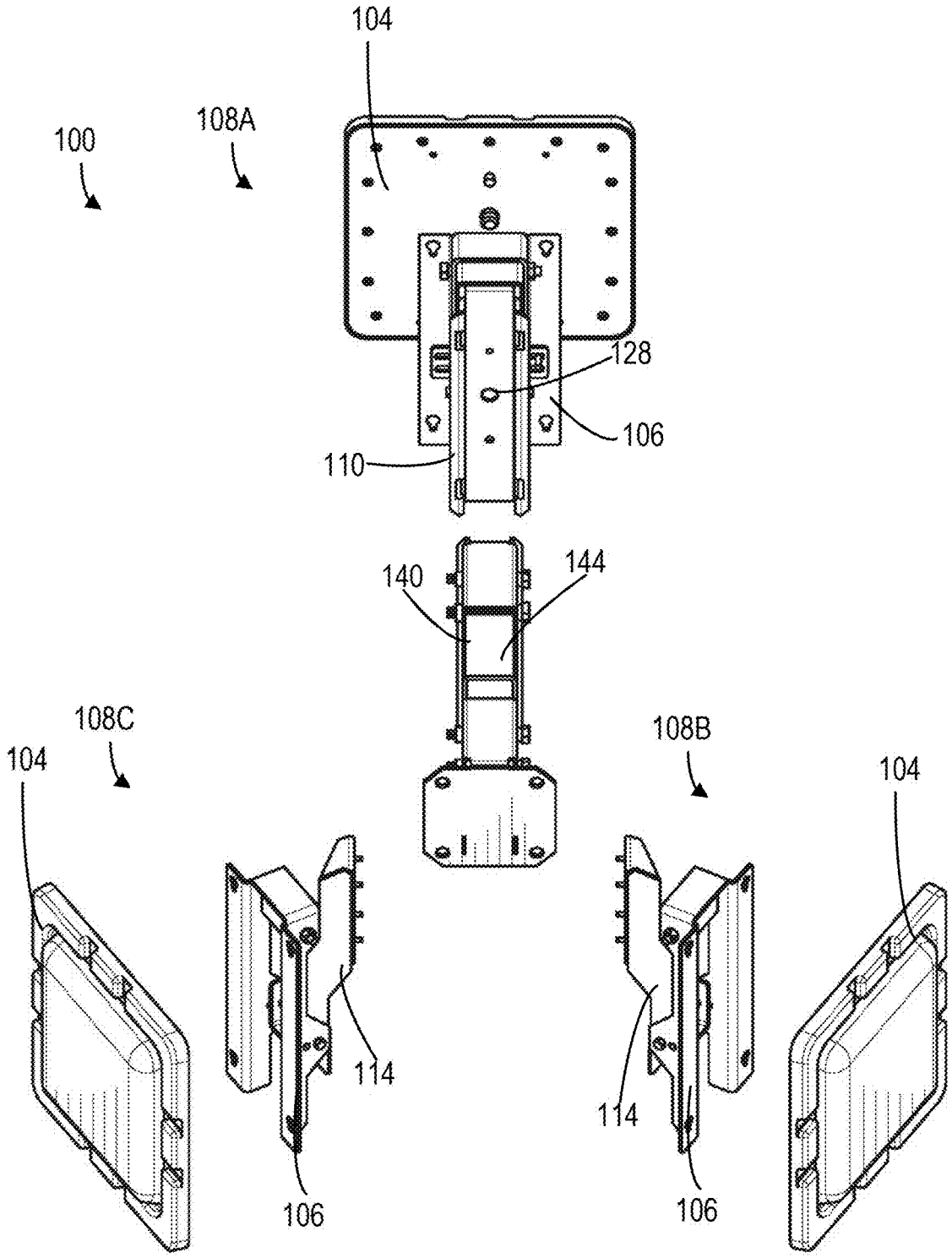
FIG. 3 is an assembly view of a portion of the sectorized antenna assembly of FIG. 1.
Figure 4:
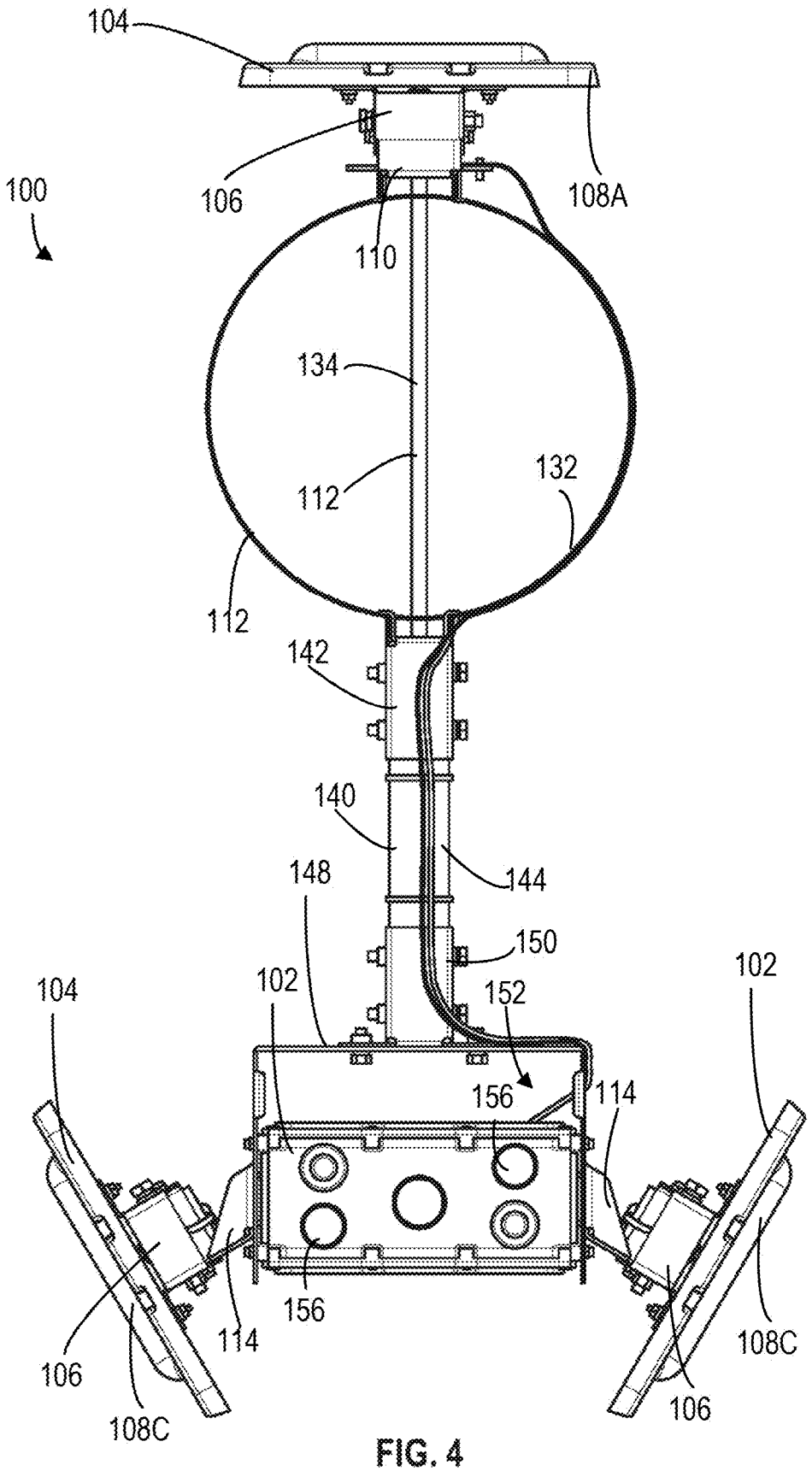
FIG. 4 is a top view of the sectorized antenna assembly of FIG. 1.
Figure 5:
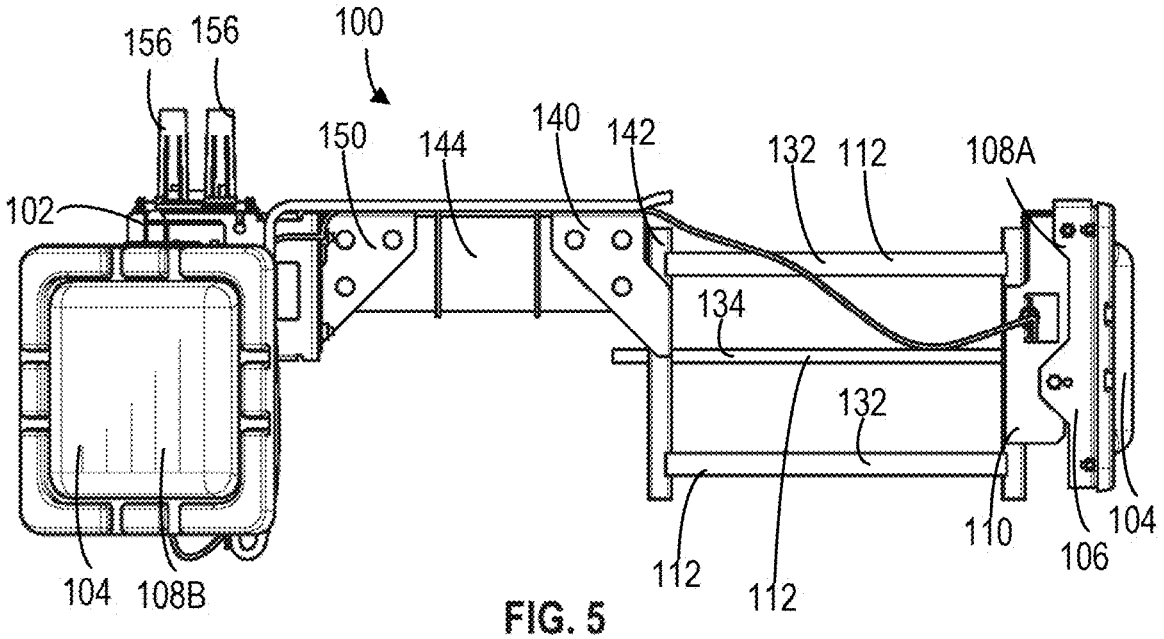
FIG. 5 is a side view of the sectorized antenna assembly of FIG. 1.
Figure 6:
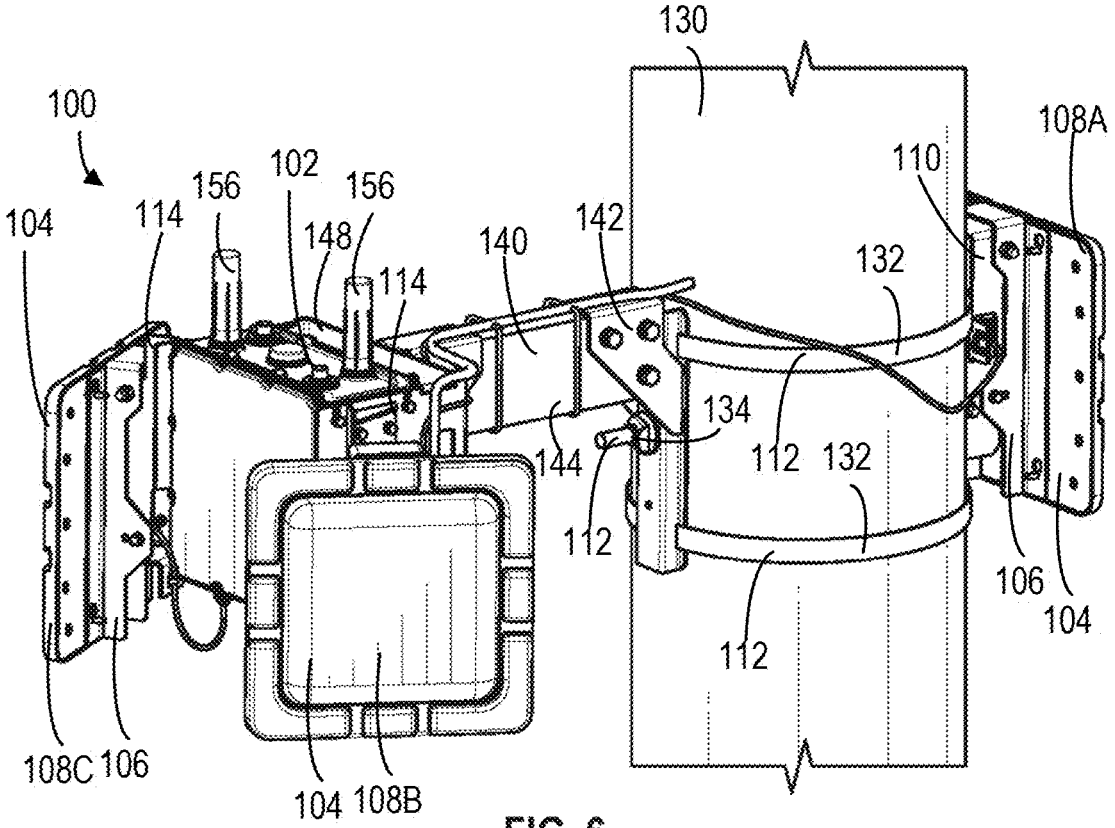
FIG. 6 is a perspective view of the sectorized antenna assembly of FIG. 1 in a first mounting configuration and mounted on a structure according to various embodiments.
Figure 8:
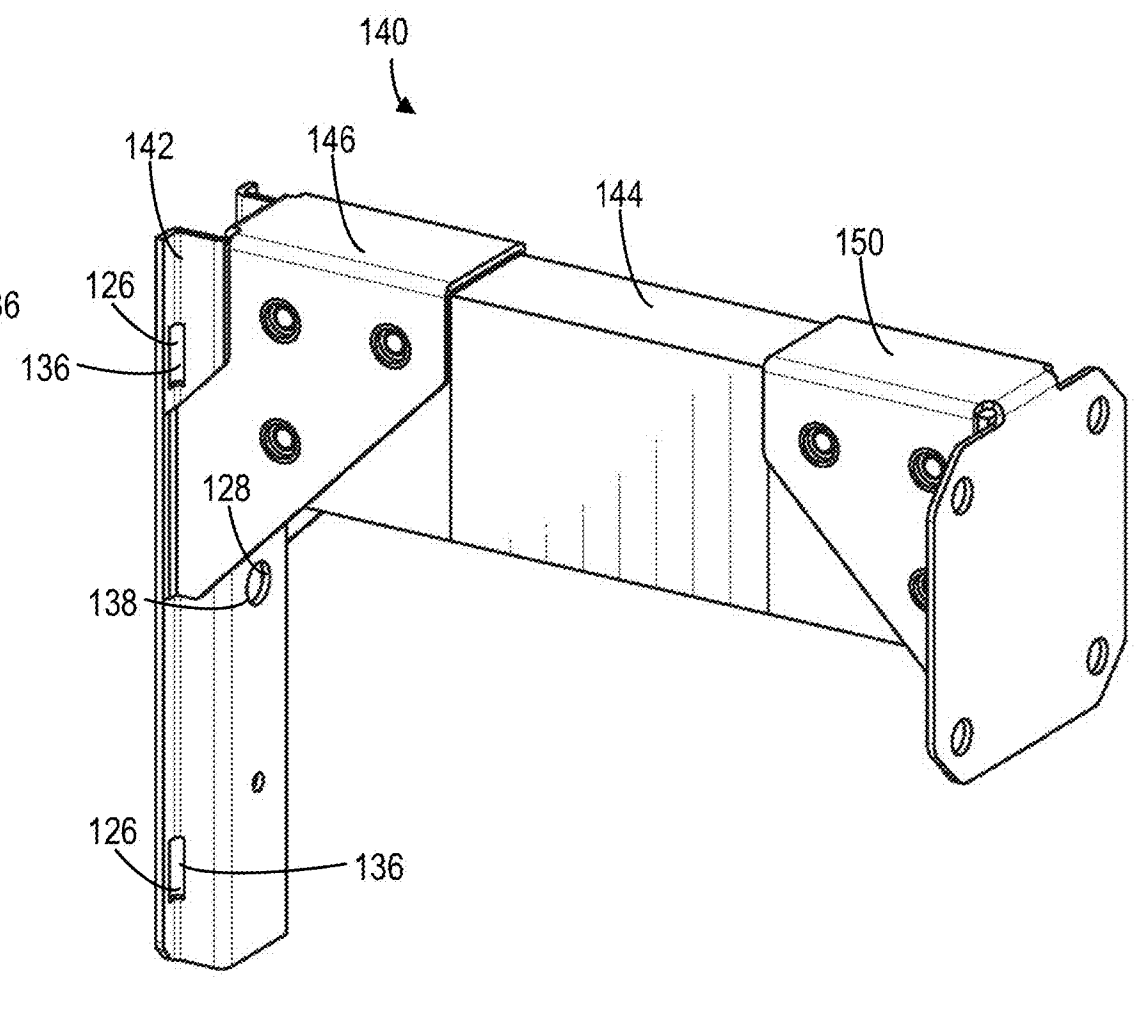
FIG. 8 is a perspective view of the support bracket and a support arm of the sectorized antenna assembly of FIG. 1 according to various embodiments.
Figure 7:
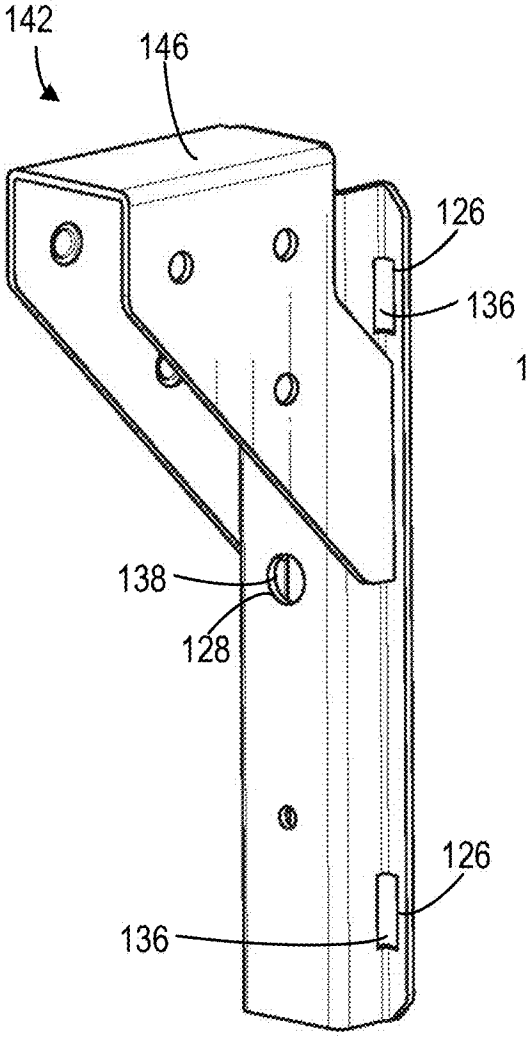
FIG. 7 is a perspective view of a support bracket of the sectorized antenna assembly of FIG. 1 according to various embodiments.
Figure 9:
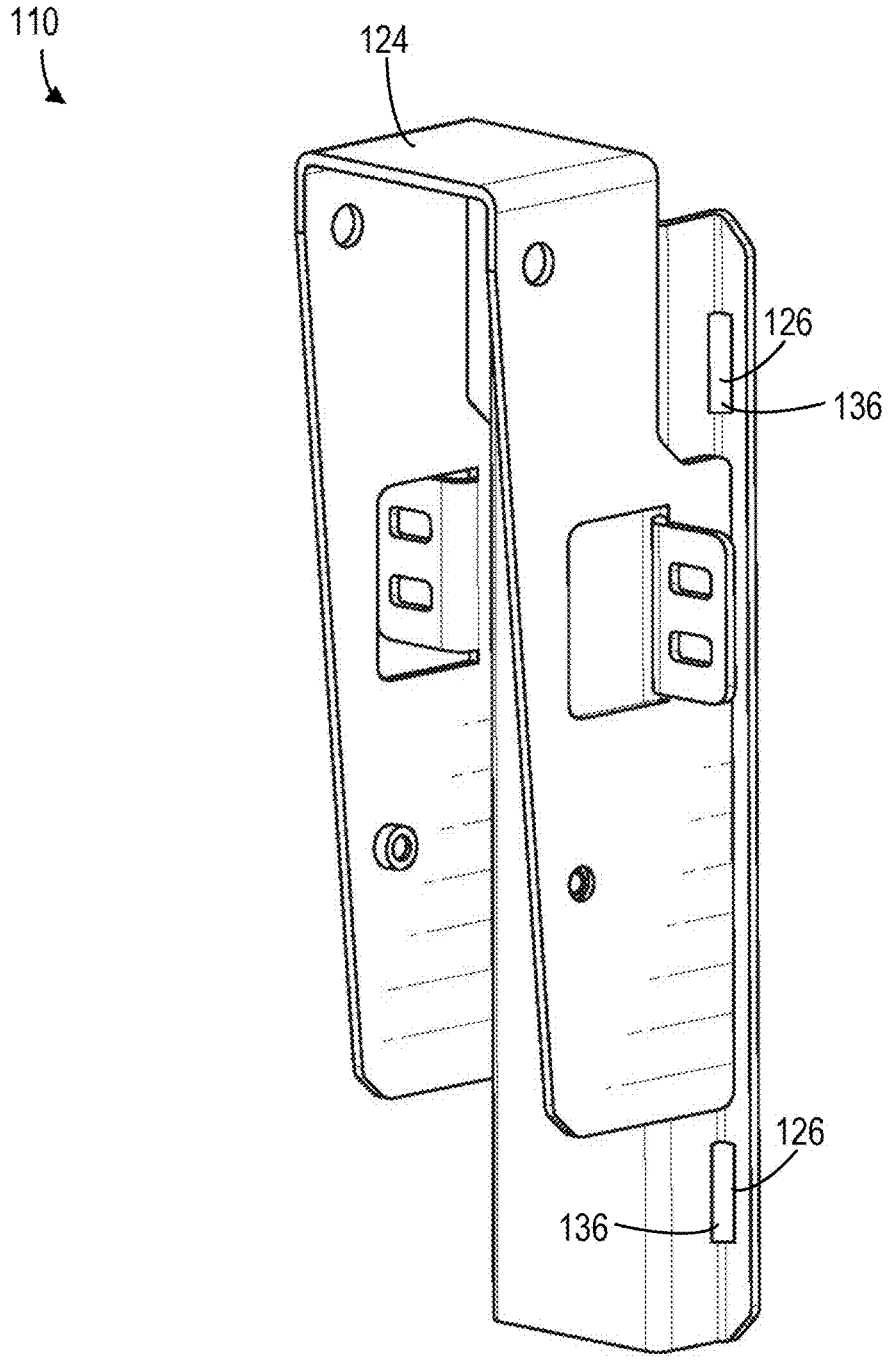
FIG. 9 is a perspective view of a portion of an antenna bracket of the sectorized antenna assembly of FIG. 1 according to various embodiments.

The support arm bracket 142 may be substantially similar to the mounting bracket 110 and includes the at least one first mounting feature 126 and the at least one second mounting feature 128. Similar to the mounting bracket 110, the support arm bracket 142 includes a support region 146. The support region 146 engages and supports the support arm 144 as best illustrated in FIGS. 1, 2, and 4-6. As best illustrated in FIGS. 4 and 5, the support arm 144 extends outwards from the support arm bracket 142 and the mounting devices 112 in the lateral direction such that the antenna assemblies 108B-C are offset in the lateral direction from the mounting devices 112 and compared to the antenna assembly 108A. In certain examples, a length of the support arm 144 is adjustable such that a distance by which the antenna assemblies 108B-C are offset from the mounting devices 112 is adjustable as desired.

In some embodiments, the intermediate bracket(s) 114 may be directly connected to the support arm assembly 140 via various suitable attachment mechanisms as desired. In other examples, and as illustrated in FIGS. 1-6, the support arm assembly 140 supports a node bracket 148, and the intermediate bracket(s) 114 are supported on the node bracket 148 via various suitable attachment mechanisms as desired, including but not limited to mechanical fasteners. In various aspects, the node bracket 148 may receive and support the node 102 on the sectorized antenna assembly. In the examples with the node bracket 148, the support arm assembly 140 may also include a connector bracket 150 on an end of the support arm 144 opposite from the support arm bracket 142, and the node bracket 148 may be connected to the support arm assembly 140 via the connector bracket 150 and using various suitable attachment mechanisms as desired, including but not limited to mechanical fasteners.

The node bracket 148 includes a receiving area 152 in which the node 102 may be supported via various suitable mechanisms as desired, including but not limited to mechanical fasteners. The node 102 may be various types of nodes of the mesh network, and the particular node 102 illustrated should not be considered limiting on the disclosure. In certain examples, the node 102 may include various electronics and components for supporting multiple communication technologies as desired. As some non-limiting examples, the node 102 may include one or more radios or communication modules, a processor and memory, a power source such as a battery, one or more sensors, a global positioning (or other location detection) antenna 154, one or more cellular (omnidirectional) antennas 156, and/or other components as desired. In one non-limiting example, the node 102 may be a network gateway for the mesh network.

In these examples, the support arm assembly 140 directly connects with the one or more mounting devices 112 such that the antenna assemblies 108B-C are not directly connected to the one or more mounting devices 112. While the two antenna assemblies 108B-C are illustrated as being supported by the support arm assembly 140, in other examples, a single antenna assembly or more than two antenna assemblies may be supported by the support arm assembly 140. Optionally, and as best illustrated in FIG. 5, the antenna assemblies 108B-C supported by the support arm assembly 140 may be at a vertical height that is different from a vertical height of the antenna assembly 108A directly mounted on the one or more mounting devices 112. In such examples, the antenna assemblies 108A-C may at least partially overlap in the lateral direction even though they may be at offset vertical heights. In certain examples, the antenna assemblies 108B-C supported by the support arm assembly 140 may be at a vertical height that is the same as the vertical height of the antenna assembly 108A directly mounted on the one or more mounting device 112. In the example of FIG. 5, the antenna assembly 108A is at a vertical position above the vertical positions of the antenna assemblies 108B-C. In certain embodiments, the support arm assembly 140 supporting the node 102 and/or the antenna assemblies 108B-C at the laterally offset position may minimize or prevent a shadowing effect.

A method of assembling the sectorized antenna assembly 100 may include assembling at least one antenna assembly (e.g., the antenna assembly 108A) with a corresponding mounting bracket 110, and assembling the one or more mounting devices 112 with the mounting bracket 110 such that the at least one antenna assembly is directly connected to the one or more mounting devices 112.

Referring to FIGS. 12 and 13, in some embodiments, the method includes assembling a plurality of antenna assemblies with corresponding mounting brackets 110, and assembling each mounting bracket 110 with the one or more mounting devices 112. In such embodiments, the method may include supporting the sectorized antenna assembly 100 on the support structure 130 via the one or more mounting devices 112 before assembling the mounting brackets 110 on the one or more mounting devices 112 or after assembling the mounting brackets 110 on the one or more mounting devices 112.

Referring to FIGS. 1-6, in other embodiments, the method may include assembling the support arm assembly 140, and supporting at least one antenna assembly (e.g., the antenna assemblies 108B-C) on the support arm assembly 140 such that they are offset from the one or more mounting devices 112 in the lateral direction. In some embodiments, assembling the support arm assembly 140 includes assembling the support arm 144 with the support arm bracket 142, and assembling the support arm bracket 142 with the one or more mounting devices 112. Optionally, the support arm bracket 142 may be assembled with the one or more mounting devices 112 before or after the one or more mounting devices 112 are secured on the support structure 130. The method optionally includes assembling the node bracket 148 on the support arm assembly 140, and supporting the antenna assemblies 108B-C on the node bracket 148 via the intermediate brackets 114. In various embodiments, the method includes supporting the node 102 on the node bracket 148.

In various embodiments, the method may optionally include controlling an angle of one or more sector antennas 104 relative to the vertical axis 120. In some embodiments, controlling the angel of one or more sector antennas 104 may include tilting the one or more sector antennas 104 such that an axis 116 of the particular antenna assembly 108A-C is at the non-parallel angle 118 relative to the vertical axis 120.

In certain embodiments, a vertical space or height occupied by the sectorized antenna assembly 100 in the configuration illustrated in FIGS. 1-6 (with the node 102) or in the configuration illustrated in FIGS. 12 and 13 (without the node 102) is compact compared to existing antenna installations. In some non-limiting examples, the vertical height of the sectorized antenna assembly 100 may be about 36 inches. In some non-limiting examples, the vertical height may be less than 36 inches, such as about 18 inches. In other examples, the vertical height of the sectorized antenna assembly 100 may be less than 36 inches or greater than 36 inches. The compact space of the sectorized antenna assembly 100 may still provide coverage as desired while also allowing for other portions of the support structure 130 to be utilized for other purposes. The compact sectorized antenna assembly 100 may also make it easier and more efficient to assemble and otherwise access the components of the sectorized antenna assembly 100.

A collection of exemplary embodiments are provided below, including at least some explicitly enumerated as "Illustrations" providing additional description of a variety of example embodiments in accordance with the concepts described herein. These illustrations are not meant to be mutually exclusive, exhaustive, or restrictive; and the disclosure not limited to these example illustrations but rather encompasses all possible modifications and variations within the scope of the issued claims and their equivalents.

Illustration 1. A sectorized antenna assembly comprising: a mounting device configured to support the sectorized antenna assembly on a structure; a support arm connected to the mounting device and extending outwards from the mounting device in a lateral direction; a first antenna assembly comprising a first antenna bracket and a first sector antenna, wherein the first antenna bracket is directly connected to the mounting device and supports the first sector antenna; and a second antenna assembly comprising a second antenna bracket and a second sector antenna, wherein the second sector antenna is supported on the second antenna bracket, and wherein the second antenna assembly is supported by the support arm such that the support arm is between the second sector antenna and the mounting device and such that the second antenna assembly is offset in the lateral direction from the mounting device compared to the first antenna assembly.

Illustration 2. The sectorized antenna assembly of any preceding or subsequent illustrations or combination of illustrations, wherein a length of the support arm is adjustable such that a distance by which the second antenna assembly is offset from the mounting device in the lateral direction is adjustable.

Illustration 3. The sectorized antenna assembly of any preceding or subsequent illustrations or combination of illustrations, further comprising a node bracket configured to support a node of a wireless network, wherein the node bracket is connected to the support arm, and wherein the second antenna bracket is connected to the node bracket.

Illustration 4. The sectorized antenna assembly of any preceding or subsequent illustrations or combination of illustrations, wherein at least one of the first antenna bracket or the second antenna bracket is tiltable relative to a vertical axis.

Illustration 5. The sectorized antenna assembly of any preceding or subsequent illustrations or combination of illustrations, wherein the mounting device comprises at least one of a mounting band or a mounting rod.

Illustration 6. The sectorized antenna assembly of any preceding or subsequent illustrations or combination of illustrations, wherein the first sector antenna is at a first vertical height relative to the mounting device, and wherein the second sector antenna is at a second vertical height relative to the mounting device that is vertically offset from the first vertical height and such that the first sector antenna at least partially overlaps the second sector antenna in the lateral direction.

Illustration 7. The sectorized antenna assembly of any preceding or subsequent illustrations or combination of illustrations, wherein the first antenna bracket comprises a first mounting feature configured to connect to a first type of mounting device and a second mounting feature configured to connect to a second type of mounting device that is different from the first type of mounting device, and wherein the mounting device comprises at least one of the first type of mounting device or the second type of mounting device.

Illustration 8. The sectorized antenna assembly of any preceding or subsequent illustrations or combination of illustrations, wherein a distance between the second antenna assembly and the mounting device in the lateral direction is adjustable.

Illustration 9. A sectorized antenna assembly comprising: a mounting device configured to support the sectorized antenna assembly on a structure; a first antenna assembly comprising a first antenna bracket and a first sector antenna, wherein the first antenna bracket supports the first sector antenna relative to the mounting device; and a second antenna assembly comprising a second antenna bracket and a second sector antenna, wherein the second antenna bracket supports the second sector antenna relative to the mounting device, wherein the first sector antenna is at a first vertical height relative to the mounting device, and wherein the second sector antenna is at a second vertical height relative to the mounting device that is vertically offset from the first vertical height and such that the first sector antenna at least partially overlaps the second sector antenna in a lateral direction.

Illustration 10. The sectorized antenna assembly of any preceding or subsequent illustrations or combination of illustrations, wherein the first antenna bracket is tiltable relative to the mounting device such that an orientation of the first sector antenna relative to the mounting device is adjustable.

Illustration 11. The sectorized antenna assembly of any preceding or subsequent illustrations or combination of illustrations, wherein the sectorized antenna assembly comprises a top end and a bottom end, wherein at least one of the first antenna assembly or the second antenna assembly defined the bottom end, and wherein a distance from the top end to the bottom end is 36 inches.

Illustration 12. The sectorized antenna assembly of any preceding or subsequent illustrations or combination of illustrations, further comprising a support arm connected to the mounting device and extending outwards from the mounting device in the lateral direction, and wherein the support arm supports the second antenna assembly such that the support arm is between the second sector antenna and the mounting device and such that the second antenna assembly is offset in the lateral direction from the mounting device compared to the first antenna assembly.

Illustration 13. The sectorized antenna assembly of any preceding or subsequent illustrations or combination of illustrations, further comprises a third antenna assembly comprising a third antenna bracket and a third sector antenna, wherein the support arm supports the third antenna bracket relative to the mounting device and such that an orientation of the third sector antenna relative to the support arm is different from an orientation of the second sector antenna relative to the support arm.

Illustration 14. The sectorized antenna assembly of any preceding or subsequent illustrations or combination of illustrations, wherein a distance between the second antenna assembly and the mounting device in the lateral direction is adjustable.

Illustration 15. The sectorized antenna assembly of any preceding or subsequent illustrations or combination of illustrations, further comprising a node bracket configured to support a node of a wireless network, wherein the node bracket is connected to the support arm, and wherein the second antenna bracket is connected to the node bracket.

Illustration 16. A sectorized antenna assembly comprising: a mounting device configured to support the sectorized antenna assembly on a structure, wherein the mounting device comprises at least one of a first type of mounting device or a second type of mounting device that is different from the first type of mounting device; a first antenna assembly comprising a first antenna bracket and a first sector antenna, wherein the first antenna bracket is directly connected to the mounting device and supports the first sector antenna; and a second antenna assembly comprising a second antenna bracket and a second sector antenna, wherein the second antenna bracket is directly connected to the mounting device and supports the second sector antenna, wherein the first antenna bracket and the second antenna bracket each comprise a first mounting feature configured to connect to the first type of mounting device and a second mounting feature configured to connect to the second type of mounting device.

Illustration 17. The sectorized antenna assembly of any preceding or subsequent illustrations or combination of illustrations, wherein the first mounting feature comprises a pair of slots aligned in a first direction on each of the first antenna bracket and the second antenna bracket, and wherein the second mounting feature comprises an aperture extending in a direction substantially perpendicular to the pair of aligned slots.

Illustration 18. The sectorized antenna assembly of any preceding or subsequent illustrations or combination of illustrations, wherein the first type of mounting device comprises a metal band configured to extend through the pair of slots on each of the first antenna bracket and the second antenna bracket, and wherein the second type of mounting device comprises a bolt configured to engage each of the first antenna bracket and the second antenna bracket via the aperture.

Illustration 19. The sectorized antenna assembly of any preceding or subsequent illustrations or combination of illustrations, wherein the first antenna bracket and the second antenna bracket are each tiltable relative to the mounting device.

Illustration 20. The sectorized antenna assembly of any preceding or subsequent illustrations or combination of illustrations, wherein the first sector antenna and the second sector antenna are aligned in a lateral direction.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described embodiments, nor the claims that follow.

That which is claimed:

1. A sectorized antenna assembly comprising:

a mounting device configured to support the sectorized antenna assembly on a structure;

a support arm connected to the mounting device and extending outwards from the mounting device in a lateral direction;

a first antenna assembly comprising a first antenna bracket and a first sector antenna, wherein the first antenna bracket is directly connected to the mounting device and supports the first sector antenna; and a second antenna assembly comprising a second antenna bracket and a second sector antenna, wherein the second sector antenna is supported on the second antenna bracket, and wherein the second antenna assembly is supported by the support arm such that the support arm is between the second sector antenna and the mounting device and such that the second antenna assembly is offset in the lateral direction from the mounting device compared to the first antenna assembly.

2. The sectorized antenna assembly of claim 1, wherein a length of the support arm is adjustable such that a distance by which the second antenna assembly is offset from the mounting device in the lateral direction is adjustable.

3. The sectorized antenna assembly of claim 1, further comprising a node bracket configured to support a node of a wireless network, wherein the node bracket is connected to the support arm, and wherein the second antenna bracket is connected to the node bracket.

4. The sectorized antenna assembly of claim 1, wherein at least one of the first antenna bracket or the second antenna bracket is tiltable relative to a vertical axis.

5. The sectorized antenna assembly of claim 1, wherein the mounting device comprises at least one of a mounting band or a mounting rod.

6. The sectorized antenna assembly of claim 1, wherein the first sector antenna is at a first vertical height relative to the mounting device, and wherein the second sector antenna is at a second vertical height relative to the mounting device that is vertically offset from the first vertical height and such that the first sector antenna at least partially overlaps the second sector antenna in the lateral direction.

7. The sectorized antenna assembly of claim 1, wherein the first antenna bracket comprises a first mounting feature configured to connect to a first type of mounting device and a second mounting feature configured to connect to a second type of mounting device that is different from the first type of mounting device, and wherein the mounting device comprises at least one of the first type of mounting device or the second type of mounting device.

8. The sectorized antenna assembly of claim 1, wherein a distance between the second antenna assembly and the mounting device in the lateral direction is adjustable.

9. A sectorized antenna assembly comprising:

a mounting device configured to support the sectorized antenna assembly on a structure;

a first antenna assembly comprising a first antenna bracket and a first sector antenna, wherein the first antenna bracket supports the first sector antenna relative to the mounting device; and a second antenna assembly comprising a second antenna bracket and a second sector antenna, wherein the second antenna bracket supports the second sector antenna relative to the mounting device, wherein the first sector antenna is supported at a first vertical height relative to the mounting device, and wherein the second sector antenna is supported at a second vertical height relative to the mounting device that is vertically offset from the first vertical height and such that the first sector antenna at least partially overlaps the second sector antenna in a lateral direction.

10. The sectorized antenna assembly of claim 9, wherein the first antenna bracket is tiltable relative to the mounting device such that an orientation of the first sector antenna relative to the mounting device is adjustable.

11. The sectorized antenna assembly of claim 9, wherein the sectorized antenna assembly comprises a top end and a bottom end, wherein at least one of the first antenna assembly or the second antenna assembly defined the bottom end, and wherein a distance from the top end to the bottom end is 36 inches.

12. The sectorized antenna assembly of claim 9, further comprising a support arm connected to the mounting device and extending outwards from the mounting device in the lateral direction, and wherein the support arm supports the second antenna assembly such that the support arm is between the second sector antenna and the mounting device and such that the second antenna assembly is offset in the lateral direction from the mounting device compared to the first antenna assembly.

13. The sectorized antenna assembly of claim 12, further comprises a third antenna assembly comprising a third antenna bracket and a third sector antenna, wherein the support arm supports the third antenna bracket relative to the mounting device and such that an orientation of the third sector antenna relative to the support arm is different from an orientation of the second sector antenna relative to the support arm.

14. The sectorized antenna assembly of claim 12, wherein a distance between the second antenna assembly and the mounting device in the lateral direction is adjustable.

15. The sectorized antenna assembly of claim 12, further comprising a node bracket configured to support a node of a wireless network, wherein the node bracket is connected to the support arm, and wherein the second antenna bracket is connected to the node bracket.

16. A sectorized antenna assembly comprising:

a mounting device configured to support the sectorized antenna assembly on a structure, wherein the mounting device comprises at least one of a first type of mounting device or a second type of mounting device that is different from the first type of mounting device;

a first antenna assembly comprising a first antenna bracket and a first sector antenna, wherein the first antenna bracket is directly connected to the mounting device and supports the first sector antenna; and a second antenna assembly comprising a second antenna bracket and a second sector antenna, wherein the second antenna bracket is directly connected to the mounting device and supports the second sector antenna, wherein the first antenna bracket and the second antenna bracket each comprise a first mounting feature configured to connect to the first type of mounting device and a second mounting feature configured to connect to the second type of mounting device.

17. The sectorized antenna assembly of claim 16, wherein the first mounting feature comprises a pair of slots aligned in a first direction on each of the first antenna bracket and the second antenna bracket, and wherein the second mounting feature comprises an aperture extending in a direction substantially perpendicular to the pair of aligned slots.

18. The sectorized antenna assembly of claim 17, wherein the first type of mounting device comprises a metal band configured to extend through the pair of slots on each of the first antenna bracket and the second antenna bracket, and wherein the second type of mounting device comprises a bolt configured to engage each of the first antenna bracket and the second antenna bracket via the aperture.

19. The sectorized antenna assembly of claim 16, wherein the first antenna bracket and the second antenna bracket are each tiltable relative to the mounting device.

20. The sectorized antenna assembly of claim 16, wherein the first sector antenna and the second sector antenna are aligned in a lateral direction.

* * * * *